United States Patent [19]

Janicka et al.

[11] Patent Number: 4,704,195

[45] Date of Patent: Nov. 3, 1987

[54] METHOD OF REDUCING $NO_x$ COMPONENT OF FLUE GAS IN HEATING COKING OVENS, AND AN ARRANGEMENT OF COKING OVEN FOR CARRYING OUT THE METHOD

[75] Inventors: Johannes Janicka, Oberhausen; Wilhelm Jakobi, Essen; Heinz Dürselen, Essen; Günter Meyer, Essen, all of Fed. Rep. of Germany

[73] Assignee: Krupp Koppers GmbH, Essen, Fed. Rep. of Germany

[21] Appl. No.: 796,582

[22] Filed: Nov. 8, 1985

[30] Foreign Application Priority Data

Dec. 1, 1984 [DE] Fed. Rep. of Germany ..... 3443976

[51] Int. Cl.[4] ..... C10B 5/04; C10B 21/06; C10B 21/18; C10B 21/24

[52] U.S. Cl. ..... 201/41; 202/139; 202/142

[58] Field of Search ..... 201/41; 202/139, 141, 202/142, 143, 144, 151; 110/345; 423/235; 431/5, 10

[56] References Cited

U.S. PATENT DOCUMENTS

| | | | |
|---|---|---|---|
| 2,746,913 | 5/1956 | Schurhoff | 202/151 |
| 3,544,429 | 12/1970 | Kulakov | 202/139 |
| 3,661,720 | 5/1972 | Jakobi | 202/139 |
| 3,839,156 | 10/1974 | Jakobi et al. | 201/41 |
| 3,996,109 | 12/1976 | Pries | 202/141 |
| 4,004,938 | 1/1977 | Pries | 202/142 |
| 4,115,515 | 9/1978 | Tenner et al. | 423/235 |
| 4,216,060 | 8/1980 | Murata et al. | 202/139 |
| 4,405,587 | 9/1983 | McGill et al. | 423/235 |
| 4,416,732 | 11/1983 | Gernhardt et al. | 202/139 |

FOREIGN PATENT DOCUMENTS 1571657 4/1973 Fed. Rep. of Germany .

*Primary Examiner*—Barry S. Richman
*Assistant Examiner*—Joye L. Woodard
*Attorney, Agent, or Firm*—Michael J. Striker

[57] ABSTRACT

In regenerative coking ovens having vertical heating flues cooperating in pairs, high level and low level combustion stages and means arranged at the bottoms of respective heating flues to recirculate the flue gas, the following measures insure a substantially reduced generation of $NO_x$ contents in the flue gas: the recirculation current rate is between 20% and 50%, the combustion stage ratio is between 40% and 70% and the second combustion stage is arranged between 35% and 55% of the height of the heating flue.

2 Claims, 4 Drawing Figures

(A-A)

(B-B)

(C-C)

( D-D )

METHOD OF REDUCING $NO_x$ COMPONENT OF FLUE GAS IN HEATING COKING OVENS, AND AN ARRANGEMENT OF COKING OVEN FOR CARRYING OUT THE METHOD

BACKGROUND OF THE INVENTION

The coking oven is of the type which includes heating flues cooperating in pairs, high level and low level combustion stages and a flue gas recirculation (a recirculating path) at the bottom of heating flues.

It is known that nitrous oxide produced in coking ovens is primarily the so-called thermal $NO_x$ whose production rate depends almost linearly on the product of oxygen and nitrogen concentrations in the flame, and exponentially on the flame temperature.

Known measures for reducing $NO_x$ generation are concerned with the reduction of the flame temperature by recirculating the flue gas, with the reduction of oxygen and nitrogen concentrations through partial combustion.

The principle of the flue gas recirculation in coking ovens is effected in the Koppers recirculation type ovens. In the latter ovens, flue gas is admixed through one or two openings in each second partition or header wall at the bottom level of the heating flue, with the air- and heating gas current. This measure markedly reduces the $NO_x$ production rate primarily due to the reduction of the maximum flame temperature but also due to the reduction of the $O_2$ and $N_2$ concentrations.

The principle of partial combustion is employed in coking furnaces operating with a stage heating.

In the endeavour to further lower the $NO_x$ emission in coking furnaces, theoretical and experimental investigations have been made in this direction. As a result of these studies it has been found that a combination of the principle of flue gas recirculation (a recirculation current heating) with the combustion in two stages (stagewise heating) can achieve a further reduction of the produced $NO_x$.

In principle, the combination of the stagewise heating with the recirculating current heating in coking ovens is known. The abovementioned investigation however has shown that an arbitrary combination of the stage heating with the recirculating current heating does not lead automatically to a noticeable reduction of $NO_x$.

SUMMARY OF THE INVENTION

It is therefore a general object of the present invention to provide an improved method and arrangement which substantially reduces the $NO_x$ component in flue gases in coking ovens.

In keeping with this object and others which will become apparent hereafter, one feature of the method of this invention resides, in a combination of the following steps:

a. Adjusting the recirculation rate, that means the volume ratio of the recirculated flue gas branch current to the flue gas current without recirculation, to amount between 20% and 50%;

b. Adjusting the stage ratio to amount between 45% and 70%, that means the volume ratio of the air current in the low level combustion stage to the secondary air current in the high level combustion stage c. Placing the high level combustion stage between 35% and 65% of the height of the heating flues.

In the preferred embodiment of the method of this invention which minimizes the $NO_x$ emission, the recirculation current rate is between 35% and 45% and the stage ratio is between 50% and 65%, and the second or high combustion stage is between 40% and 50% of the height of the heating flue.

In order to carry out the method of this invention, the coking oven is designed such that the supply ducts leading to the second, high level combustion stage to feed into the latter the secondary air current and the secondary low intensity flue gas current, are arranged exclusively in the header partitions separating respective pairs of heating flues.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
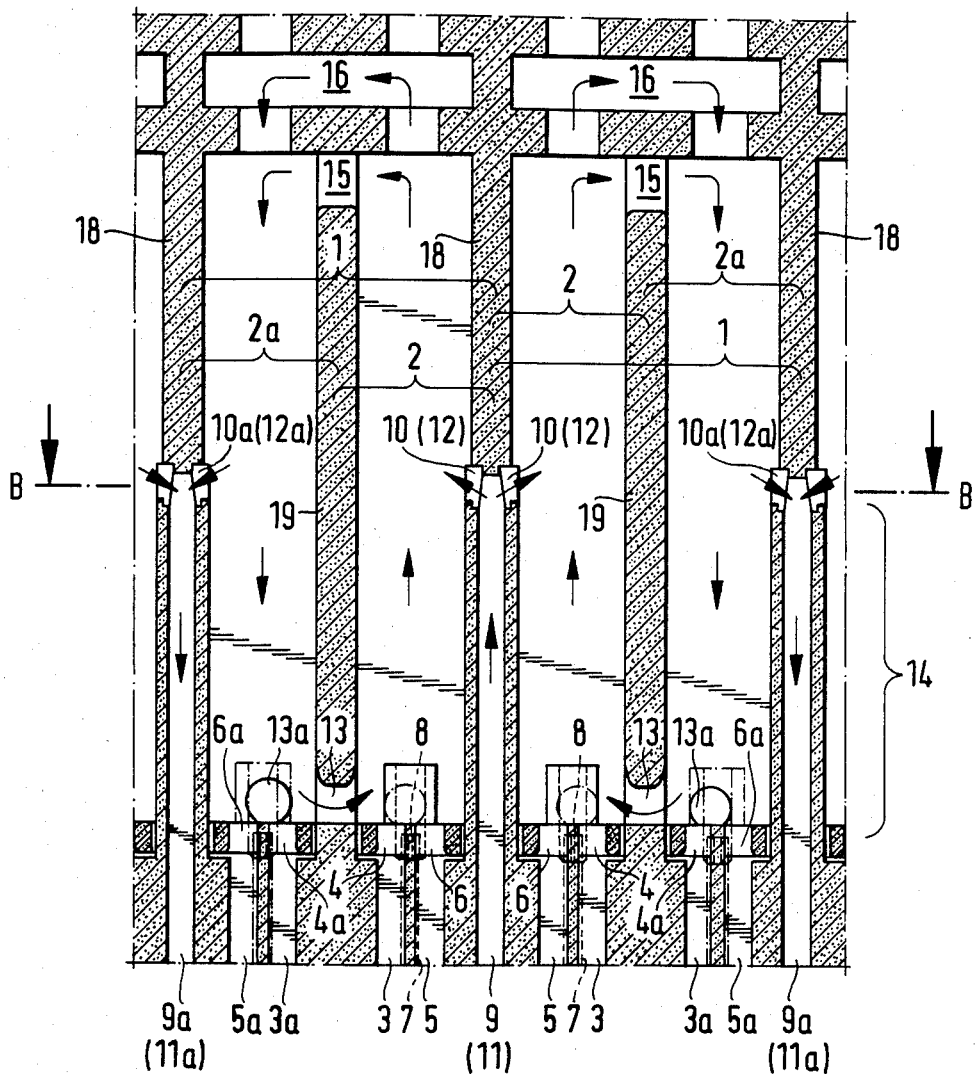
FIG. 1 shows a sectional side view of two adjacent pairs of heating flues of a combination coking oven or vertical flue regenerating oven, the vertical section being taken along line A—A of FIG. 2.

In the embodiments of coking ovens illustrated in the drawing, the supply of combustion media into the heating flues is effected from non-illustrated regenerators. The arrangement of regenerators, heating flues or pairs of vertical heating flues, is applicable both for combination ovens that means coking ovens selectively operated with high intensity or low intensity gas heating, and also for high intensity gas ovens. In the drawing the direction of flow of the combustion media (air, low intensity gas, high intensity gas, exhaust gas) during one heating cycle is indicated by arrows. Since the illustrated ovens are regenerative ovens, in the subsequent heating period the direction of flow of the combustion media is reversed.

In the drawing, reference numeral 1 denotes a pair of heating flues, 2 refers to a flamed heating flue, **2*a* is a non-flamed heating flue, 3 is a primary air channel, 3*a* is a primary channel for conducting exhaust gas, 4 denotes regulation for the channel 3, 4*a* is regulation for the channel 3*a*, 5 is a channel for primary low intensity gas, 5*a* is an exhaust gas conducting channel for the primary low intensity gas, 6 denotes a regulation for channel 5, 6*a* denotes a regulation for channel 5*a*, 7 is a high intensity gas channel, 8 is a nozzle for high intensity gas, 9 is a channel for secondary air, 9*a* is an exhaust gas conducting channel for secondary air. Reference numeral 10 denotes adjustable outlets for channel 9, and 10*a* denotes adjustable outlets for channel 9*a*. For the sake of clarity the regulating or adjustment means are not shown in the drawing. Reference numeral 11 indicates a channel for the secondary low intensity gas, 11*a* indicates an exhaust gas conducting channel for the secondary low intensity gas, 12 refers to adjustable outlets of channels 11, 12***a* relates to adjustable outlets to channel 11*a* (regulating members not shown), 13 indicates passages for circulating currents, 13*a* indicates a regulating roller for an opening 13, 14 indicates the height of the partial combustion up to the secondary air or lean gas supply (the height of the lower stoichiometric combustion). 15 denotes a return passage, 16 a differential channel, 17 indicates runner walls, 18 refers to header walls with secondary ducts (air supplying stage) and 19 indicates header walls with return passages and recirculating means.

The fluid combustion media are supplied into the heating flues 2 in the following manner:

Primary air from an air generator is supplied through channels 3 and the adjustable outlet 4;

the primary low intensity gas from gas generator is supplied through channels 5 and the adjustable outlet 6;

high intensity gas is supplied through channel 7 and through exchangeable nozzles 8;

in the high combustion stage which, as mentioned before, is arranged between 35% and and 55% of the height of the heating flues, secondary air is fed through channels 9 and the adjustable outlet 10;

secondary low intensity or lean gas is supplied through channels 11 and the adjustable outlet 12; and return gas is fed through adjustable channels 13 (openings for circulating current).

The partial combustion takes place in the heating flue over the height 14.

The path of flue gases extends from the flamed heating flue 2 through the reversing passage 15 and partially through the differential channel 16 into the non-flamed heating flue 2*a* and then via nozzles and channels 4*a*, 3*a*, 6*a*, 5*a*, 10*a*, 9*a*, 12*a*, 11*a* into the non-illustrated exhaust gas regenerators.

Figure 2:
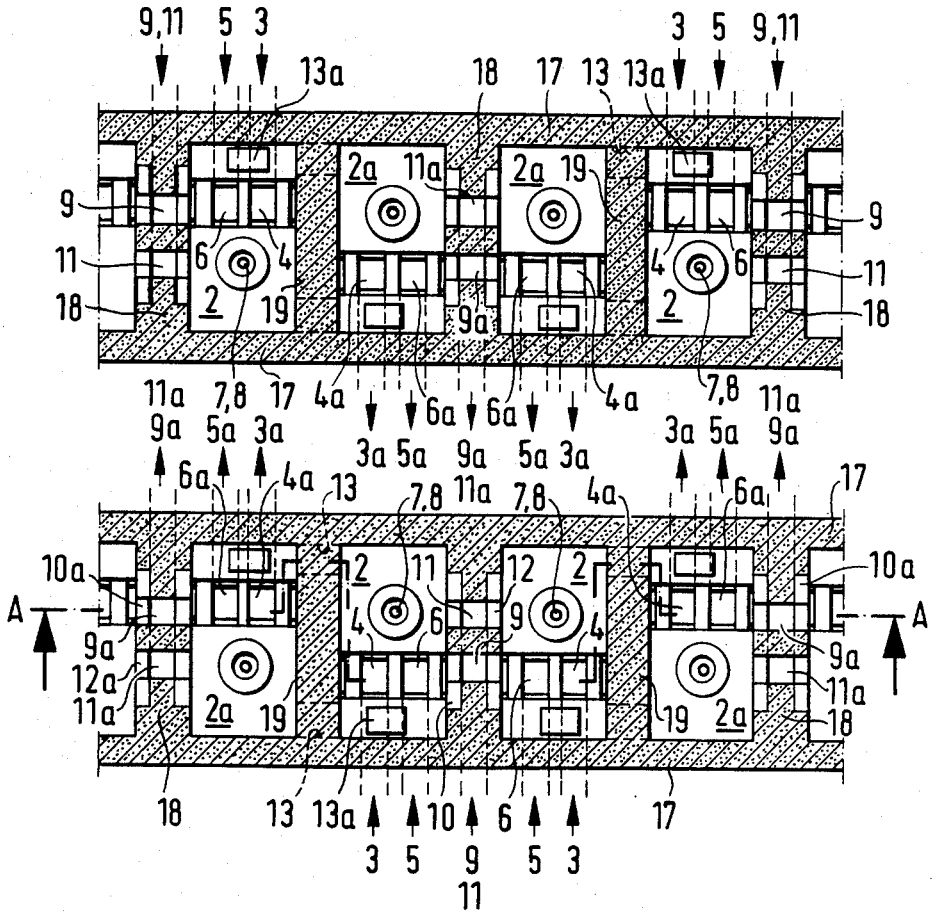
FIG. 2 is a horizontal section taken along the line B—B of the oven of FIG. 1.
Figure 3:
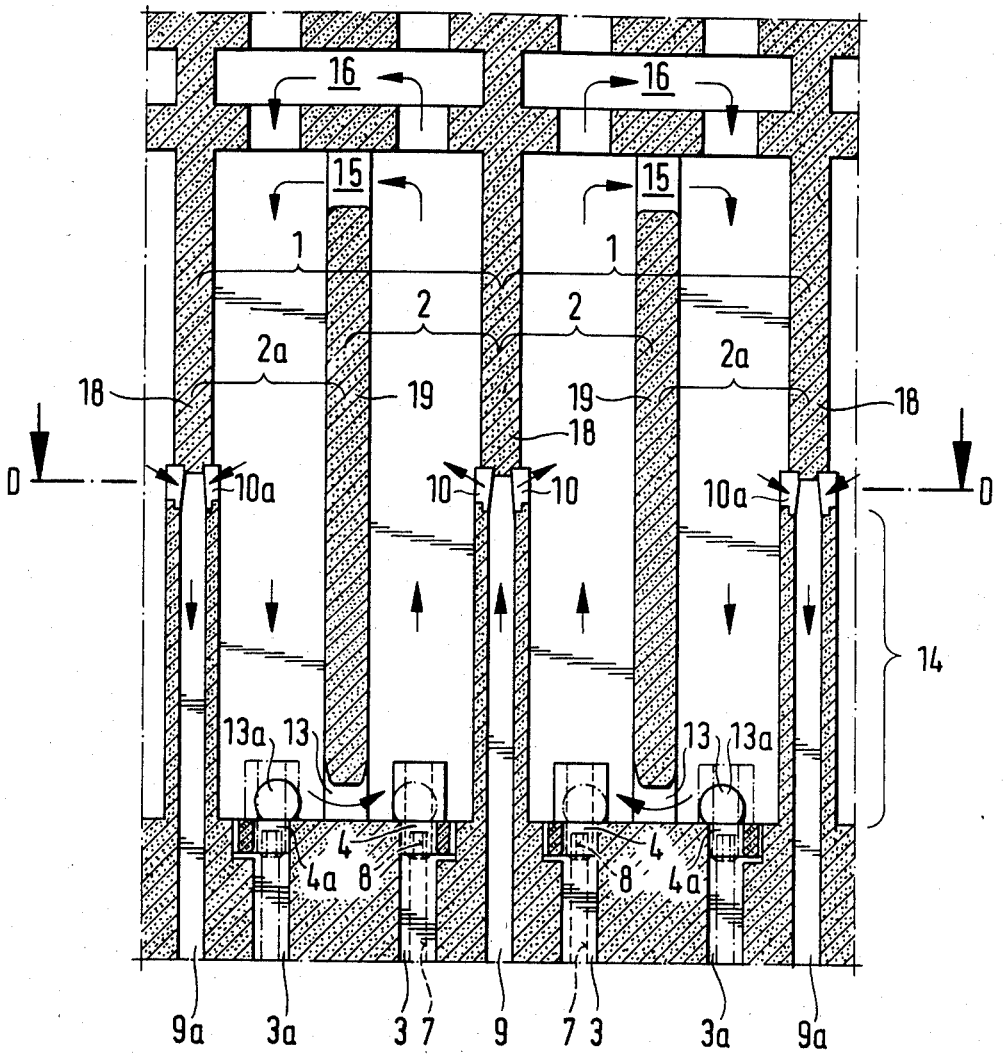
FIG. 3 is a sectional side view of two adjacent pairs of heating flues of a high intensity gas oven, the section being taken along the line C—C of FIG. 4.
Figure 4:
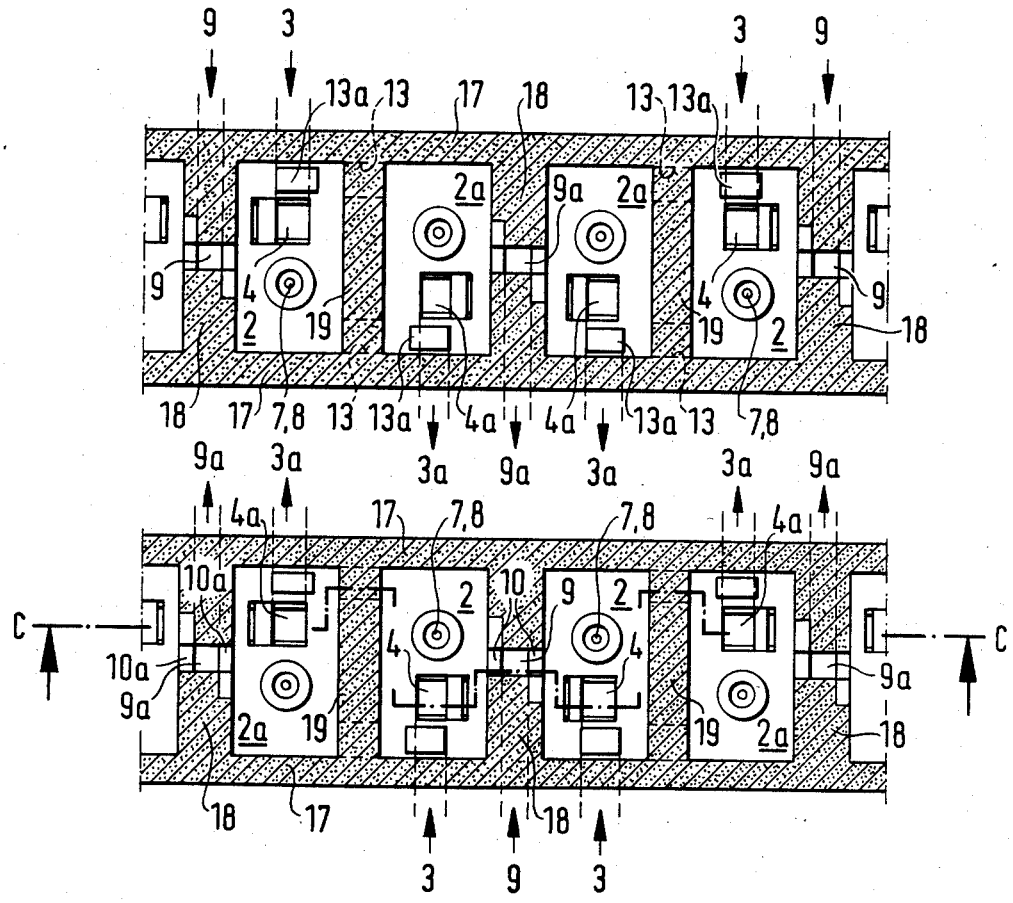
FIG. 4 is a horizontal cross-section taken along the line D—D in the oven of FIG. 3.

As mentioned before, in FIGS. 1 and 2, the arrows indicate the directions of flow of combustion media both for the low intensity or lean gas operation as well as for the high intensity or rich gas operation. In the case of low intensity gas operation there is no flow of rich gas, whereas in the rich gas mode of operation both the air channels 9 and channels 11 for low intensity gas conduct combustion air.

Lateral boundary of each pair 1 of heating flues is established by runner walls 17 and by transverse header walls 18 formed with channels 9 and 11 for secondary currents of air and low intensity gas. The partition or header wall 19 between heating flues 2 and 2*a* in each flue pair 1 is provided with a top passage 15 for reversing flue gas from the flamed flue 2 into the non-flamed flue 2*a* and with a bottom passage 13 for recirculating a branch current of flue gas into the flamed flue.

By virtue of the arrangement or spatial separation of the header walls 18 and 19 to form partitions provided with recirculating means and partitions provided with air conducting means, and in combination with free inlets for rich gas, most favorable streaming conditions are created which enable a thorough intermixing of the circulating current with the combustion media supplied in the low level combustion stage.

While the invention has been illustrated and described as embodied in a specific examples of coking ovens, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of reducing $NO_x$ component of flue gas produced in the flame of a coking oven of the type having a plurality of vertical heating flues cooperating in pairs of flamed and non-flamed flues, the flamed heating flues including inlets for rich gas, primary air and lean gas arranged at the bottom region of the flues to provide a low level combustion stage, and further including inlets for secondary air and secondary lean gas arranged above said low level combustion stage to provide a high level combustion stage, partitions separating the flamed and non-flamed heating flues in respective pairs having a top opening for recirculating flue gas from the flamed flue to the non-flamed one, and a bottom opening for mixing a branch current of the recirculated flue gas with the supplied primary air and rich and lean gases in the flamed flue, comprising the steps of:

a. adjusting the recirculation current rate, namely the volume ratio of the recirculated flue gas branch current to the flue gas current without recirculation, to amount between 20% and 50%;

b. adjusting the combustion stage ratio, namely the volume ratio of the supplied primary air in the low level combustion stage to the supplied secondary air in the high level combustion stage to an amount between 40% and 70%; and c. arranging the high level combustion stage between 35% and 55% of the height of the heating flues.

2. A method as defined in claim 1, wherein said recirculation current rate is between 35% and 45%, said stage ratio is between 50% and 65% and the second high level combustion stage is between 40% and 50% of the height of the heating flue.

* * * * *